US006450599B1

(12) United States Patent
Mamuyac

(10) Patent No.: US 6,450,599 B1
(45) Date of Patent: Sep. 17, 2002

(54) LOCKER APPARATUS

(76) Inventor: Betty J. Mamuyac, P.O. Box 343706, Florida City, FL (US) 33034-0706

( * ) Notice: Subject to any disclaimer, the term of this patent is extended or adjusted under 35 U.S.C. 154(b) by 0 days.

(21) Appl. No.: 09/822,398

(22) Filed: Mar. 30, 2001

(51) Int. Cl.[7] ..... A47B 43/00
(52) U.S. Cl. ..... 312/313; 312/258
(58) Field of Search ..... 312/258, 327, 312/304, 313, 351; 108/162, 179, 134; 16/257, 258, 319, 348

(56) References Cited

U.S. PATENT DOCUMENTS

| | | | | |
|---|---|---|---|---|
| 3,677,203 A | | 7/1972 | Barrineau | |
| 3,966,286 A | * | 6/1976 | Groseclose | 312/258 |
| D264,159 S | | 5/1982 | Bennett et al. | |
| 5,154,500 A | | 10/1992 | Chang | |
| 5,415,472 A | | 5/1995 | Brise | |
| 5,671,990 A | | 9/1997 | Teasdale | |
| 5,746,331 A | | 5/1998 | Kurtis | |
| 5,833,114 A | * | 11/1998 | Linnell | |
| 5,882,098 A | * | 3/1999 | Brown et al. | 312/258 |
| 6,039,419 A | * | 3/2000 | Brown et al. | 312/258 X |
| 6,076,641 A | * | 6/2000 | Kinzer et al. | |

* cited by examiner

*Primary Examiner*—Janet M. Wilkens

(57) ABSTRACT

A locker apparatus for providing a storage locker having collapsible shelving. The locker apparatus includes a housing having a bottom wall, a first side wall, a second side wall, a top wall, and a back wall. A front of the housing has a peripheral edge defining a doorway for accessing an interior of the housing. A plurality of shelves are located in the housing and spaced from each other. Each of the shelves comprises a panel having a front edge, a back edge, and a pair of side edges. A hinge hingedly couples the back edge of the panel to the back wall such that the panel may be selectively positioned between a horizontal position and a vertical position.

5 Claims, 3 Drawing Sheets

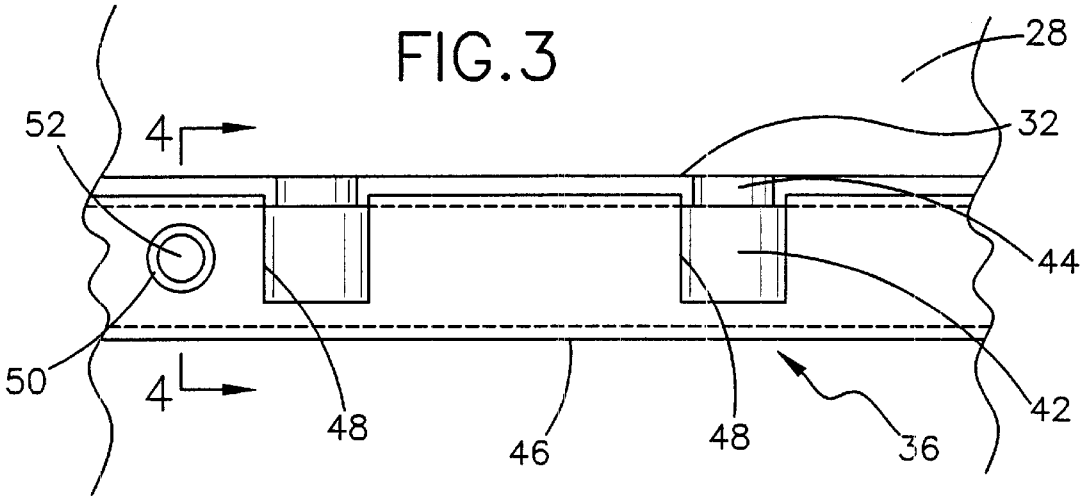
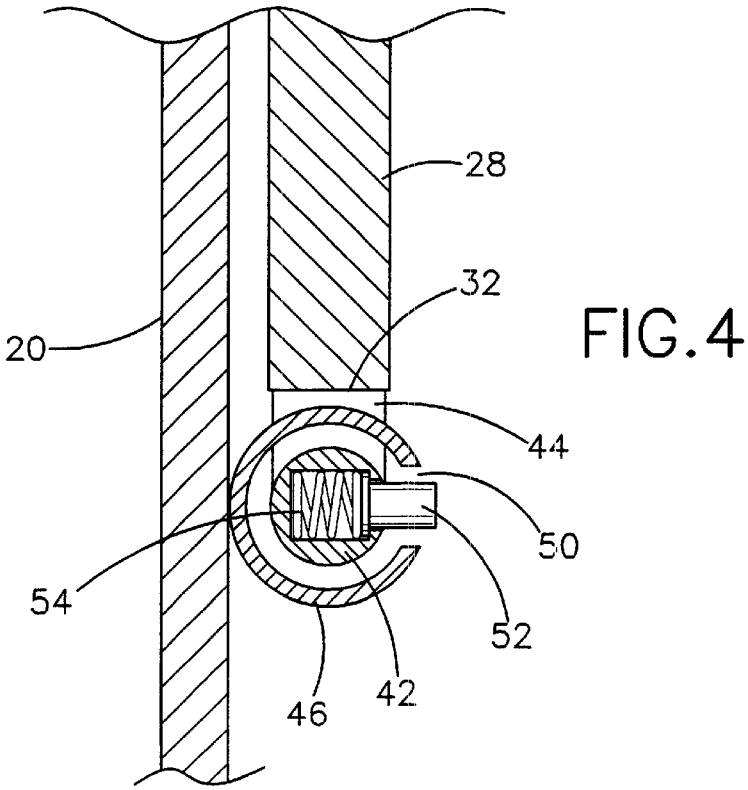
FIG.4

LOCKER APPARATUS

BACKGROUND OF THE INVENTION

1. Field of the Invention

The present invention relates to locker devices and more particularly pertains to a new locker apparatus for providing a storage locker having collapsible shelving.

2. Description of the Prior Art

The use of locker devices is known in the prior art. More specifically, locker devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,746,331; U.S. Pat. No. 5,154,500; U.S. Pat. No. 5,671,990; U.S. Pat. No. 5,415,472; U.S. Pat. No. 3,677,203; and U.S. Des. Pat. No. 264,159.

While these devices fulfill their respective, particular objectives and requirements, the aforementioned patents do not disclose a new locker apparatus. The inventive device includes a housing having a bottom wall, a top wall, a first side wall, a second side wall, and a back wall. A front of the housing has a peripheral edge defining a doorway for accessing an interior of the housing. A plurality of shelves are located in the housing and spaced from each other. Each of the shelves comprises a panel having a front edge, a back edge, and a pair of side edges. A hinge hingedly couples the back edge of the panel to the back wall such that the panel may be selectively positioned between a horizontal position and a vertical position.

In these respects, the locker apparatus according to the present invention substantially departs from the conventional concepts and designs of the prior art, and in so doing provides an apparatus primarily developed for the purpose of providing a storage locker having collapsible shelving.

SUMMARY OF THE INVENTION

In view of the foregoing disadvantages inherent in the known types of locker devices now present in the prior art, the present invention provides a new locker apparatus construction wherein the same can be utilized for providing a storage locker having collapsible shelving.

The general purpose of the present invention, which will be described subsequently in greater detail, is to provide a new locker apparatus apparatus and method which has many of the advantages of the locker devices mentioned heretofore and many novel features that result in a new locker apparatus which is not anticipated, rendered obvious, suggested, or even implied by any of the prior art locker devices, either alone or in any combination thereof.

To attain this, the present invention generally comprises a housing having a bottom wall, a top wall, a first side wall, a second side wall, and a back wall. A front of the housing has a peripheral edge defining a doorway for accessing an interior of the housing. A plurality of shelves are located in the housing and spaced from each other. Each of the shelves comprises a panel having a front edge, a back edge, and a pair of side edges. A hinge hingedly couples the back edge of the panel to the back wall such that the panel may be selectively positioned between a horizontal position and a vertical position.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new locker apparatus apparatus and method which has many of the advantages of the locker devices mentioned heretofore and many novel features that result in a new locker apparatus which is not anticipated, rendered obvious, suggested, or even implied by any of the prior art locker devices, either alone or in any combination thereof.

It is another object of the present invention to provide a new locker apparatus which may be easily and efficiently manufactured and marketed.

It is a further object of the present invention to provide a new locker apparatus which is of a durable and reliable construction.

An even further object of the present invention is to provide a new locker apparatus which is susceptible of a low cost of manufacture with regard to both materials and labor, and which accordingly is then susceptible of low prices of sale to the consuming public, thereby making such locker apparatus economically available to the buying public.

Still yet another object of the present invention is to provide a new locker apparatus which provides in the apparatuses and methods of the prior art some of the advantages thereof, while simultaneously overcoming some of the disadvantages normally associated therewith.

Still another object of the present invention is to provide a new locker apparatus for providing a storage locker having collapsible shelving.

Yet another object of the present invention is to provide a new locker apparatus which includes a housing having a bottom wall, a top wall, a first side wall, a second side wall, and a back wall. A front of the housing has a peripheral edge defining a doorway for accessing an interior of the housing.

A plurality of shelves are located in the housing and spaced from each other. Each of the shelves comprises a panel having a front edge, a back edge, and a pair of side edges. A hinge hingedly couples the back edge of the panel to the back wall such that the panel may be selectively positioned between a horizontal position and a vertical position.

Still yet another object of the present invention is to provide a new locker apparatus that has shelves which may be positioned in a vertical orientation for the placement of tall items into the locker.

Even still another object of the present invention is to provide a new locker apparatus that has locking members on the shelves to lock them in a generally vertical orientation.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a schematic front view of the hinge of the present invention.

FIG. 4 is a schematic side cross-sectional view of the hinge of the present invention.

DESCRIPTION OF THE PREFERRED EMBODIMENT

Figure 1:
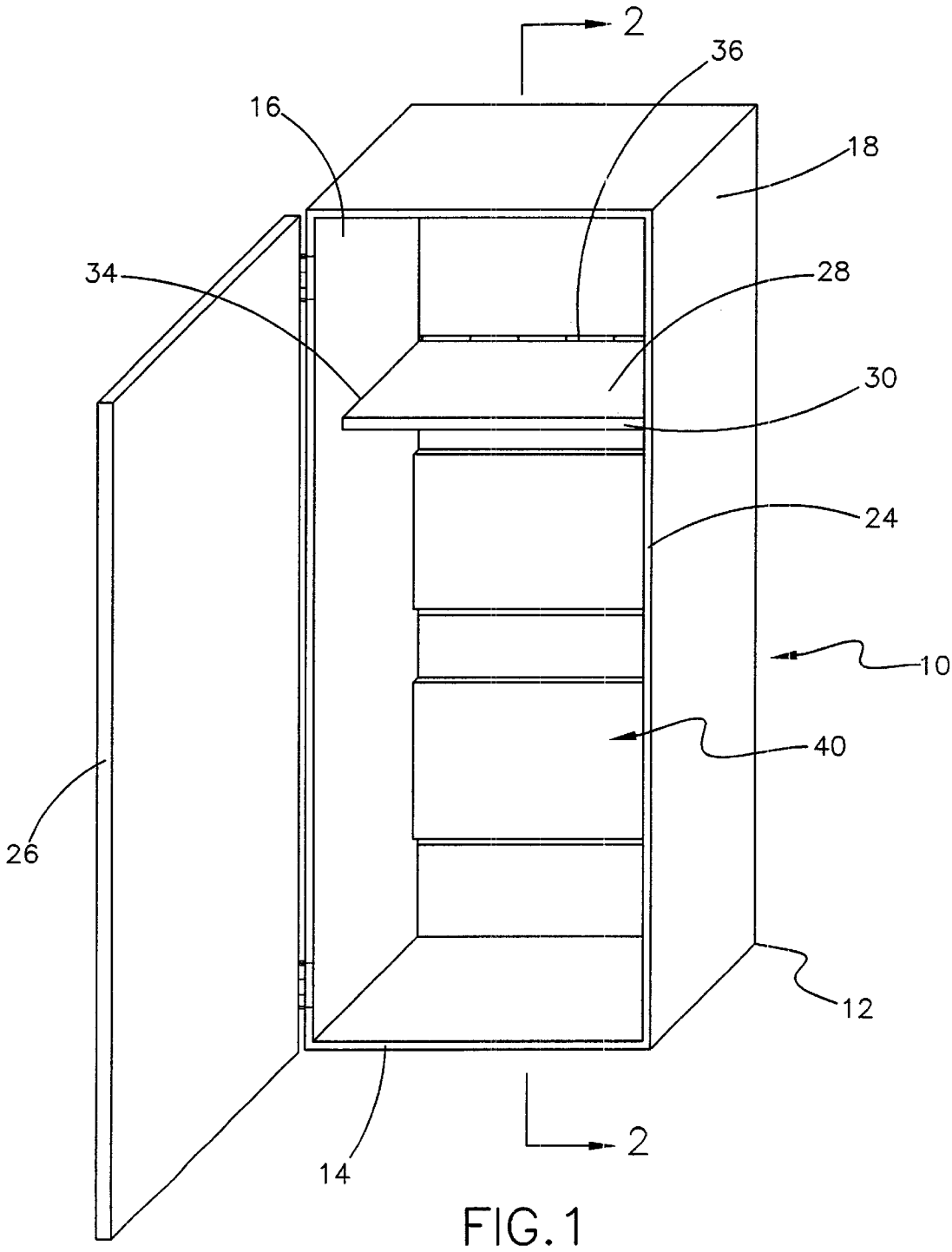
FIG. 1 is a schematic perspective view of a new locker apparatus according to the present invention.

With reference now to the drawings, and in particular to FIGS. 1 through 4 thereof, a new locker apparatus embodying the principles and concepts of the present invention and generally designated by the reference numeral 10 will be described.

As best illustrated in FIGS. 1 through 4, the locker apparatus 10 generally comprises a housing 12 having a bottom wall 14, a first side wall 16, a second side wall 18, a top wall 22 and a back wall 20. A front of the housing has a peripheral edge 24 defining a doorway for accessing an interior of the housing 12. A door 26 is hingedly coupled to the peripheral edge abutting the first side wall 16. The door 26 is selectively positioned between an open position extending away from the housing and a closed position abutting the housing 12. Also envisioned is a conventional locking device is positioned on the door 24 and a latch on the inner surface of the second side wall for locking the door 24 in the closed position.

A plurality of shelves 28 are located in the housing 12 and spaced from each other. Each of the shelves 28 comprises a panel having a front edge 30, a back edge 32, and a pair of side edges 34. Ideally there are three shelves 28 in the housing.

Figure 2:
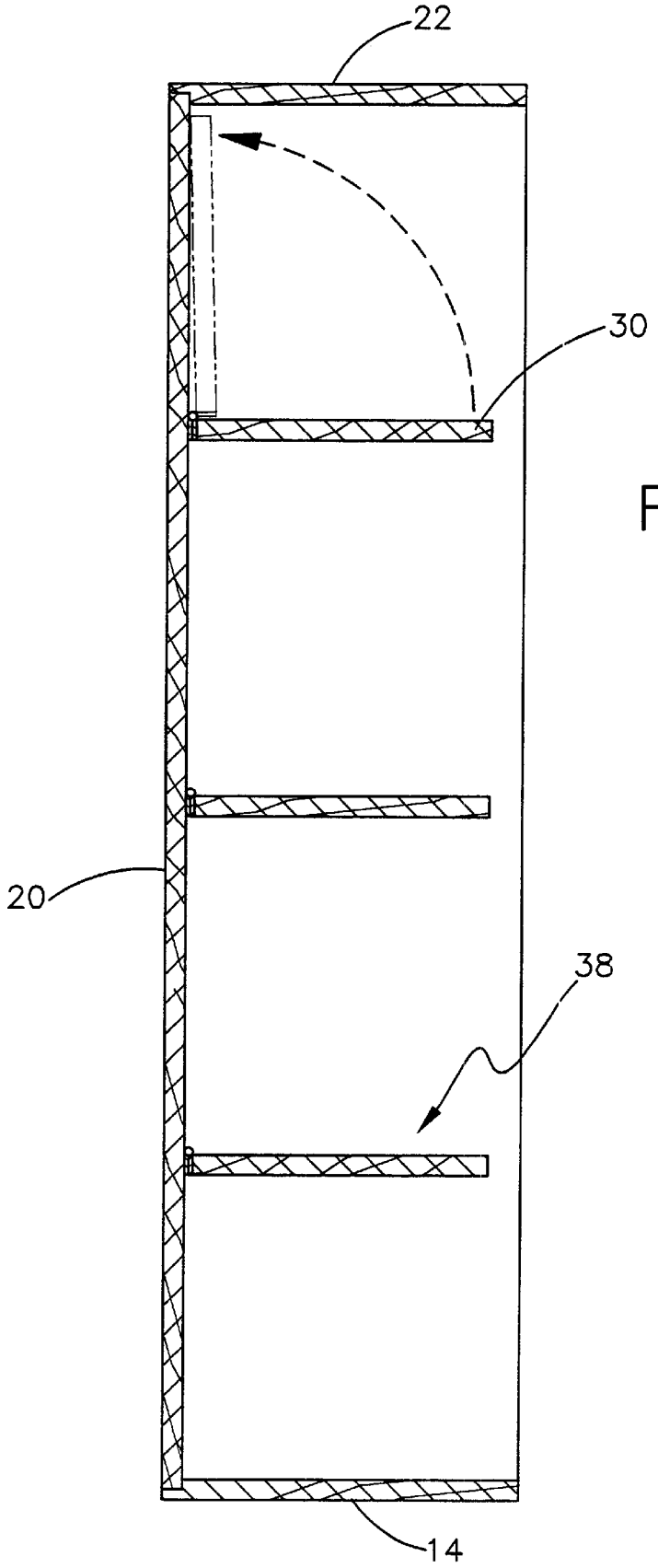
FIG. 2 is a schematic side cross-sectional view taken along line 2—2 of the present invention.

A hinge 36 hingedly couples the back edge 32 of the panel to the back wall 20 such that the panel, or shelf 28, may be selectively positioned between a horizontal position 38 and a vertical position 40 as depicted in FIGS. 1 and 2. The hinge 36 includes a rod 42 having a plurality of aligned nubs 44 attached thereto and spaced from each other. Each of the nubs 44 is attached to the back edge 32 of the panel. A tubular member 46 is attached to the back wall 20 and has a longitudinal axis horizontally orientated with respect to a ground surface. The rod 42 is located in the tubular member 46 and has a plurality slots 48 therein such that the each of the nubs 44 extends through one of the slots 48 such that the rod 42 is rotatable with respect to the tubular member 46. The nubs may be moved from a position generally extending away toward said top wall 22 to a position extending away from said back wall 20. The tubular member 46 has a peripheral wall having a hole 50 therein.

A detent 52 is extendably positioned in a peripheral wall of the rod 42 and is biased outwardly of the rod 42 by a biasing member 54, preferably a spring. The detent 52 is extendable through the hole 50 in the tubular member 46 when the panel 28 is in a vertical orientation 40.

In use, the device 10 is used as a typical locker. When needed, the detent 52 is pressed into the rod 42 and the respective shelf 28 is lowered into the horizontal position such that the user may place items on the shelves.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A locker device comprising:

a housing having a bottom wall, a top wall, a first side wall, a second side wall, and a back wall, a front of said housing having a peripheral edge defining a doorway for accessing an interior of said housing;

a plurality of shelves located in said housing and spaced from each other, each of said shelves comprising;

a panel having a front edge, a back edge, and a pair of side edges;

a hinge for hingedly coupling said back edge of said panel to said back wall such that said panel may be selectively positioned between a horizontal position and a vertical position;

said hinge comprising a rod and a tubular member;

said rod having a plurality of nubs attached thereto and spaced from each other, each of said nubs being attached to said back edge of said panel;

said tubular member attached to said back wall and having a longitudinal axis horizontally orientated, said rod being located in said tubular member and having a plurality slots therein such that said each of said nubs extends through one of said slots such that said rod is rotatable with respect to said tubular member.

2. The locker device as in claim 1, further including a locking member for locking said panel in said vertical position.

3. The locker device as in claim 2, wherein said locking member includes:

said tubular member having a peripheral wall having a hole therein; and a detent being extendably positioned in a peripheral wall of said rod and being biased outwardly of said rod, said detent being extendable through said hole in said tubular member when said panel is in a vertical orientation.

4. The locker device as in claim 1, further comprising a door being hingedly coupled to said peripheral edge abutting said first side wall, said door being selectively positioned between an open position extending away from said housing and a closed position abutting said housing.

5. A locker device comprising:

a housing having a bottom wall, a top wall, a first side wall, a second side wall, and a back wall, a front of said housing having a peripheral edge defining a doorway for accessing an interior of said housing, a door being hingedly coupled to said peripheral edge abutting said first side wall, said door being selectively positioned between an open position extending away from said housing and a closed position abutting said housing;

a plurality of shelves located in said housing and spaced from each other, each of said shelves comprising;

a panel having a front edge, a back edge, and a pair of side edges;

a hinge for hingedly coupling said back edge of said panel to said back wall such that said panel may be selectively positioned between a horizontal position and a vertical position, said hinge comprising:

a rod having a plurality of nubs attached thereto and spaced from each other, each of said nubs being attached to said back edge of said panel;

a tubular member attached to said back wall and having a longitudinal axis horizontally orientated, said rod being located in said tubular member and having a plurality slots therein such that said each of said nubs extends through one of said slots such that said rod is rotatable with respect to said tubular member, said tubular member having a peripheral wall having a hole therein;

a detent being extendably positioned in a peripheral wall of said rod and being biased outwardly of said rod, said detent being extendable through said hole in said tubular member when said panel is in a vertical orientation.

* * * * *